United States Patent [19]

Woods et al.

[11] Patent Number: 4,813,243

[45] Date of Patent: Mar. 21, 1989

[54] QUICK-CHILL ICE CHEST

[76] Inventors: Eugene A. Woods, 2906 Center St., Little Rock, Ark. 72206; Gary Worsham, 1210 Rice, Little Rock, Ark. 72202

[21] Appl. No.: 200,439

[22] Filed: May 31, 1988

[51] Int. Cl.[4] ..... F25D 3/08

[52] U.S. Cl. ..... 62/381; 62/457; 366/235

[58] Field of Search ..... 62/457, 345, 346, 381; 366/233, 235

[56] References Cited

U.S. PATENT DOCUMENTS

| | | | |
|---|---|---|---|
| 1,445,488 | 2/1923 | Clark | 366/233 |
| 1,631,999 | 6/1927 | Chandler | 366/233 X |
| 1,760,654 | 5/1930 | Maxwell | 62/342 X |
| 2,655,007 | 10/1953 | Lazar | 62/346 X |
| 4,139,992 | 2/1979 | Fraser | 62/345 |
| 4,164,851 | 8/1979 | Bryant | 62/381 |
| 4,580,405 | 4/1986 | Cretzmeyer, III | 62/457 X |
| 4,669,274 | 6/1987 | Huang | 62/342 |
| 4,722,198 | 2/1988 | Huang | 62/342 |

*Primary Examiner*—William E. Tapolcai
*Attorney, Agent, or Firm*—John J. Mulrooney

[57] ABSTRACT

A beverage container cooling apparatus for use in combination with plastic insulated ice chests having a top and a base, the cooling apparatus comprising a tray designed to fit within the base and adapted to receive ice and beverage containers positioned on the ice whereby the containers have their highest parts substantially coplanar with the opening in the base. An endless belt drive mechanism is mounted in the top and has a crank operatively connected thereto which extends outwardly through the chest top. The endless belt is designed to engage the highest parts of the beverage containers when the top and bottom are in superposed position. Operation of the crank will cause the endless belt to rotate the beverage containers on the ice which will cause the contents of the containers to be cooled.

2 Claims, 2 Drawing Sheets

QUICK-CHILL ICE CHEST

BACKGROUND OF THE INVENTION

This invention relates to beverage container cooling apparatus and more particularly to a beverage container cooling apparatus useful with commercially available plastic insulated ice chests to rapidly and simultaneously cool the contents of several beverage containers.

The prior art provides examples of beverage container cooling devices which generally comprise apparatus designed to engage and rapidly rotate the container against ice to effect a rapid heat transfer and rapid cooling of the contents of the container. The existing devices function to cool the contents of the beverage containers, but they involve the use of specially constructed apparatus. See, for example, U.S. Pat. Nos. 4,580,405; 4,164,851: 4,078,397 and 3,316,734. The prior art does not provide an economically feasible, durable and relatively troublefree in operation beverage container cooling apparatus having structural components manufactured as standard items in various sizes, thereby enabling the apparatus to e economically designed for use in combination with the many sizes of insulated ice chests commercially available.

Therefore, an object of the invention is to provide an improved beverage container cooling apparatus.

Another object of the invention is to provide a beverage container cooling apparatus which quickly and simultaneously cools the contents of several beverage containers.

Another object of the present invention is to provide a beverage container cooling apparatus which uses an endless belt to simultaneously engage and rotate a plurality of beverage containers.

Another object of the invention is to provide a beverage container cooling apparatus which is adaptable for use in combination with the various sizes of commercially available insulated ice chests.

Another object of the invention is to provide a beverage container cooling apparatus which is economical to manufacture, durable in use and efficient in operation.

Another object of the invention is to provide a beverage container cooling apparatus comprising structural components manufactured as standard items in various sizes, thereby enabling the apparatus to be economically designed for use in combination with the many sizes of insulated ice chests commercially available.

Another object of the invention is to provide a beverage container cooling apparatus which will conform to conventional forms of manufacture, be of simple construction and easy to use so as to provide a device that will be economically feasible, long lasting and relatively trouble free in operation.

SUMMARY OF THE INVENTION

The beverage container cooling apparatus of this invention is adaptable to function in combination with plastic insulated ice chests having a base and a top designed to sit on and form a closure for the base. The beverage container cooling apparatus comprises a tray designed to fit within and maintain a position adjacent to the opening of the base: the tray is provided with support means positioned to support a plurality of beverage containers in horizontally disposed position with respect to the opening of the base and in contact with ice contained in the tray. An endless belt installed in the top is adapted to engage the beverage containers supported in the tray when the chest top and bottom are in superposed position. A drive mechanism is operatively connected to the endless belt and a crank extends outwardly from the top so that operation of the crank will cause the belt to rotate which in turn causes the beverage containers to be rotated on the ice thereby quickly cooling he contents of the containers.

DESCRIPTION OF THE PREFERRED EMBODIMENT

Figure 1:
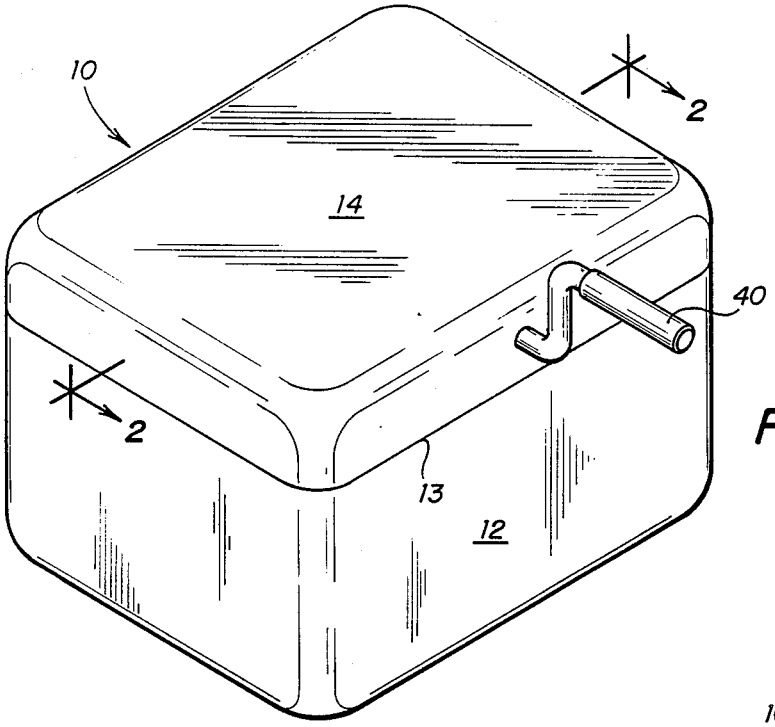
FIG. 1 is a perspective view of a plastic insulated standard ice chest with the apparatus of the invention installed therein.

Referring the drawings, the beverage container cooling apparatus of this invention is shown in combination with a plastic insulated ice chest generally designated by the reference numeral 10. The ice chest comprises a bottom or base 12 having an upwardly facing opening 13, and a top 14 designed to be removably mounted on the base 12 to cover the opening 13. Such ice chests are commercially available in various sizes.

A relatively shallow tray 16 is designed to fit within the base 12 and is supported therein by slideable elements 18 positioned on the bottom of tray 16 which extend to engage slots 19 in the walls of base 12. Slots 19 are at different elevations along the walls of base 12 to enable a single size tray 16 to accommodate different size beverage containers such as 12 oz. and 16 oz.

Tray 16 is provided with several parallel, horizontally disposed support cables 20 designed to receive and support a plurality of beverage containers 24 in a substantially horizontal position whereby the highest parts of said containers are substantially coplanar with the plane of opening 13 of base 12. Cables 20 can be nylon, or some other suitable material, which are attached to tray 16 by any suitable means. The bottom of tray 16 provides a reservoir for ice 22.

Figure 2:
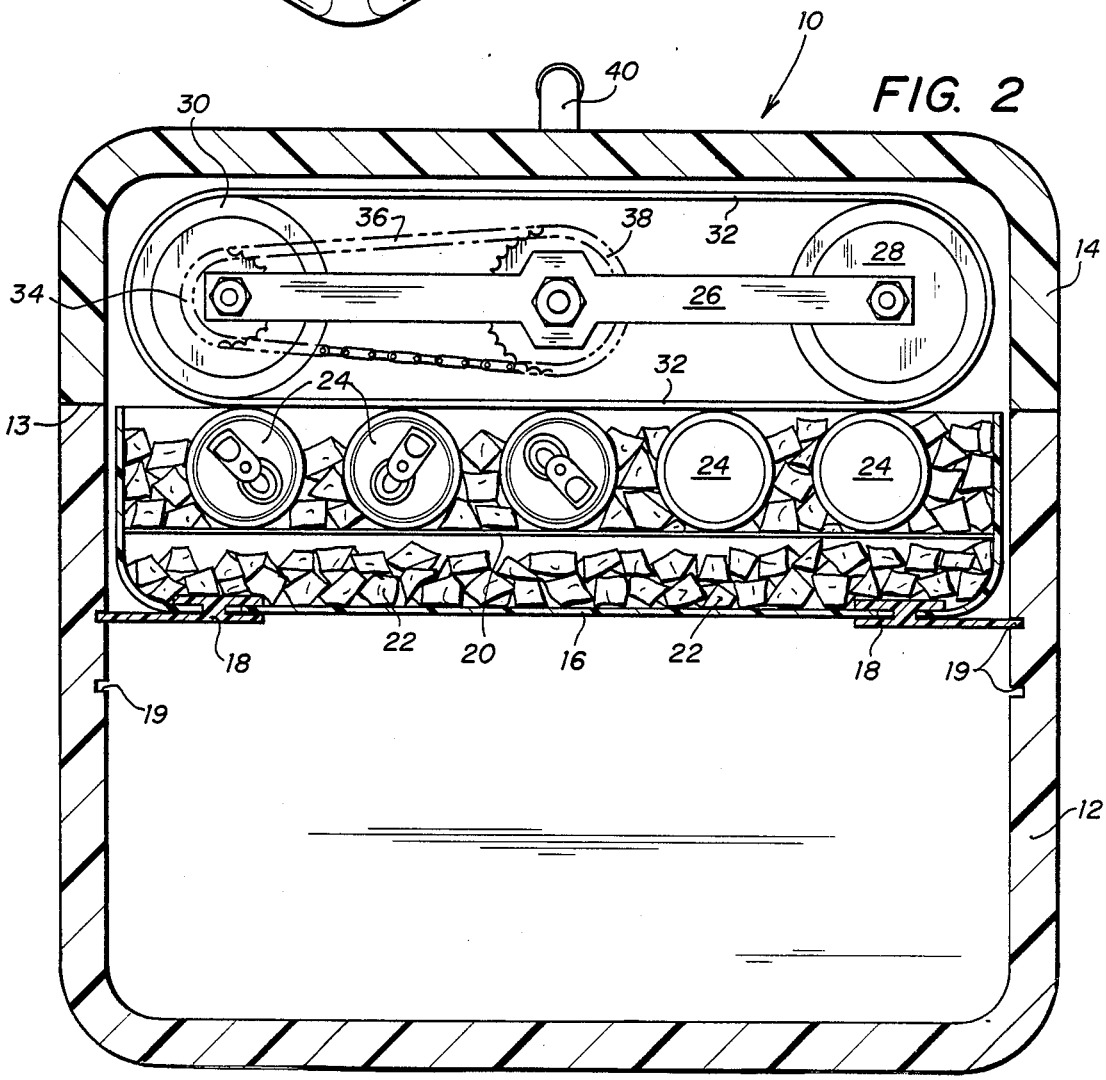
FIG. 2 is a front elevation view of the invention partly broken away taken along the lines 2—2 of FIG. 1.
Figure 3:
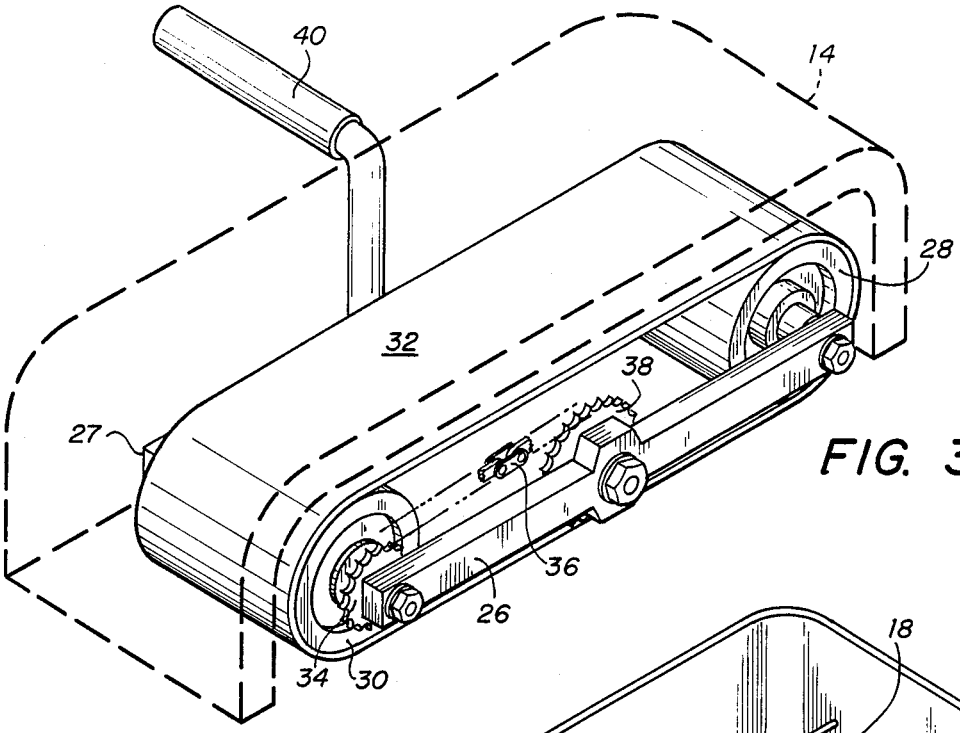
FIG. 3 is a perspective view partly broken away of the endless belt drive mechanism of the invention.
Figure 4:
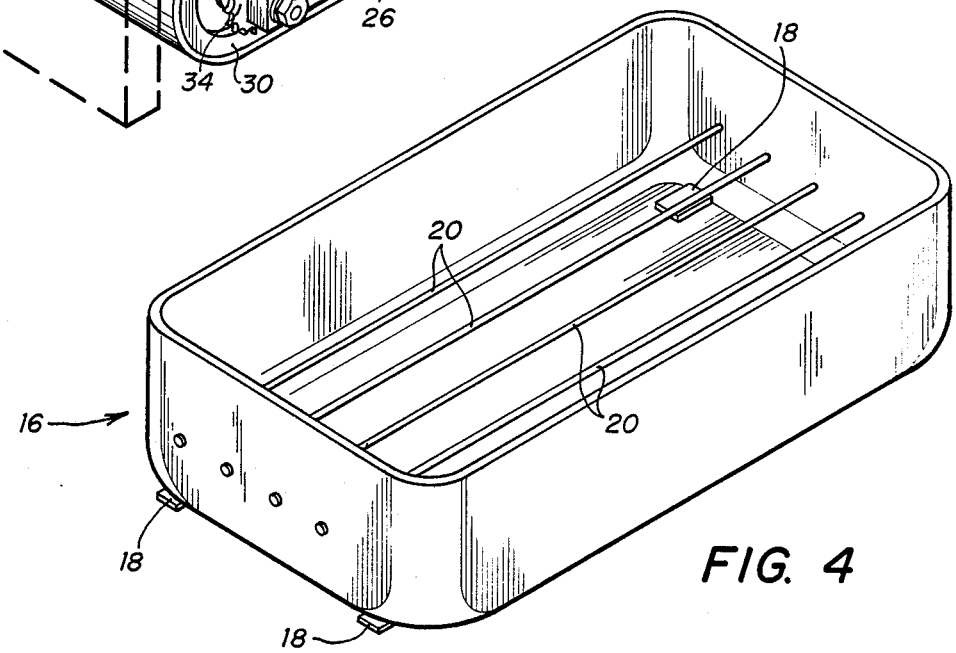
FIG. 4 is a perspective view of the tray of the invention.
Figure 5:
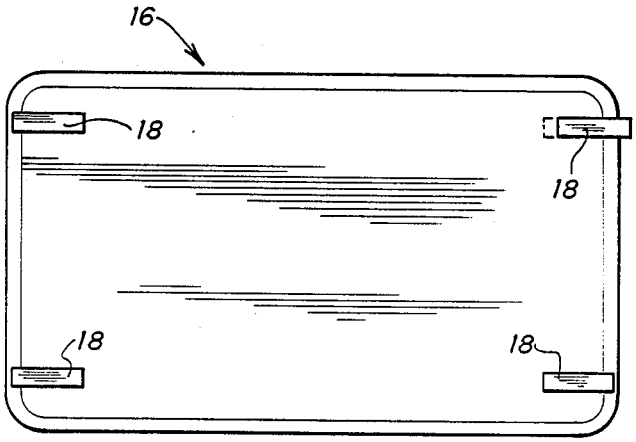
FIG. 5 is a bottom view of the tray of the invention.

The top 14 (FIGS. 2 and 3) is provided with a chain and sprocket drive mechanism comprising metal frame members 26 and 27 mounted by well-known means (not shown) to opposite walls of top 14. First 28 and second 30 rollers are mounted on frame members 26 and 27 and are connected by an elongated endless drive belt 32 made of rubber or another suitable material. A driven sprocket 34 is mounted for movement with roller 30 and is connected by a chain 36 to a drive sprocket 38. A hand crank 40 is operatively connected to drive sprocket 38. The drive mechanism is designed to fit within top 14 so that when top 14 is positioned on base 12, the endless drive belt 32 engages the highest parts of beverage containers 24 which are substantially coplanar with the opening 13 of base 12. The drive mechanism is constructed of standard item components commercially available in many sizes to conform to the various ice chest sizes available on the market. As an alternative to the hand crank, a motor could be used to drive the endless belt.

To operate the beverage container cooling apparatus of the present invention, the ice chest top 14 is removed from base 12, tray 16 is inserted into base 12 and slidable support elements 18 are extended to engage the proper set of slots 19 in base 12 as determined by the size of the beverage containers. Ice 22 is deposited in the reservoir of tray 16 to a height slightly above support cables 20. Can or bottle beverage containers 24 are positioned on support cables 20 whereby the longitudinal axes of the containers are perpendicular to the cables 20 and the containers 24 are in contact with the ice 22. Top 14 is then positioned on base 12 whereby endless belt 32 contacts each of the beverage containers 24. Hand crank 40 is then rotated to cause the rotation of endless belt 32 which causes the rotation of beverage containers 24 on the ice 22 to quickly chill the contents of the containers. Experiments have shown that the contents of two-to-six beverage containers can be quickly chilled by the apparatus of the present invention.

It can be seen that a novel beverage container cooling apparatus has been provided which is easily adaptable for use with any plastic insulated ice chest of the various sizes commercially available, which is convenient to use, and which rapidly cools the contents of the beverage containers by causing the containers to be rotated on a bed of ice. The present invention has been found capable of chilling beverages from room temperature to a desired drinking temperature in approximately two minutes. The present invention is simple in construction and efficient in operation and includes structural components that are manufactured as standard items in many sizes, thereby enabling the apparatus to be designed for use with the many plastic insulated ice chest containers of various sizes commercially available. The present invention is a simple construction which is easy to sue so as to provide a device that will be economically feasible, long lasting and relatively trouble free in operation.

What is claimed is:

1. A beverage container cooling apparatus for use in combination with an ice chest having a base with an upwardly facing opening and a top which is removably positionable on said base to cover said opening, said cooling apparatus comprising:

a tray adapted to be received and supported in said base, said tray having a plurality of container support cables horizontally disposed therein whereby beverage containers position on said cables will be maintained in a substantially horizontal attitude so that the highest parts of said containers are coplanar with the plane of said opening in said base, and said tray adapted to receive ice therein which contacts said containers positioned on said support cables:

means mounted in said top for rotating said beverage containers relative to said ice whereby the contents of said containers will be rapidly cooled by the ice, said means for rotating said containers comprising an endless belt rotatably mounted in said ice chest top whereby positioning said top on said base causes said endless belt to contact each of said beverage containers;

and a crank operatively connected to said means for rotating said endless belt, said crank extending outwardly from said ice chest top.

2. The apparatus of claim 1 wherein said means for rotating said beverage containers further comprises a chain and sprocket drive mechanism operatively connected to said endless belt and said crank.

* * * * *